US006521142B1

(12) United States Patent
Holgado et al.

(10) Patent No.: US 6,521,142 B1
(45) Date of Patent: Feb. 18, 2003

(54) FIRE-RESISTANT HYDRAULIC FLUID COMPOSITIONS

(75) Inventors: Rosauro V. Holgado, Bala Cynwyd, PA (US); Richard Adams, Phoenixville, PA (US); Chan Talaty, Collegeville, PA (US)

(73) Assignee: Houghton Technical Corp., Wilmington, DE (US)

( * ) Notice: Subject to any disclaimer, the term of this patent is extended or adjusted under 35 U.S.C. 154(b) by 262 days.

(21) Appl. No.: 09/629,125

(22) Filed: Aug. 1, 2000

Related U.S. Application Data

(62) Division of application No. 08/340,247, filed on Nov. 16, 1994, now Pat. No. 6,156,228.

(51) Int. Cl.[7] ..... C09K 5/00; H01B 3/20; C10M 0/00

(52) U.S. Cl. ..... 252/78.5; 252/79; 252/574; 508/433; 508/440

(58) Field of Search ..... 252/78.5, 79, 574; 508/433, 440

(56) References Cited

U.S. PATENT DOCUMENTS

| | | | | |
|---|---|---|---|---|
| 2,340,331 | A | | 2/1944 | Knutson |
| 2,509,620 | A | | 5/1950 | Watson |
| 2,566,623 | A | | 9/1951 | Moreton |
| 2,636,861 | A | | 4/1953 | Watson |
| 2,698,837 | A | | 1/1955 | Gamrath |
| 2,796,400 | A | | 6/1957 | Thornley |
| 2,862,886 | A | | 12/1958 | Davies |
| 2,903,428 | A | | 9/1959 | Moreton |
| 2,934,501 | A | | 4/1960 | Moreton |
| 3,236,778 | A | | 2/1966 | McIntosh |
| 3,432,437 | A | | 3/1969 | Nail |
| 3,730,889 | A | | 5/1973 | McCord |
| 3,769,221 | A | | 10/1973 | Burrous |
| 3,795,620 | A | | 3/1974 | Sheratte |
| 3,849,324 | A | | 11/1974 | Sheratte |
| 3,862,048 | A | | 1/1975 | Sheratte |
| 3,865,743 | A | | 2/1975 | Sheratte |
| 3,956,154 | A | | 5/1976 | Marolewski |
| 4,163,731 | A | | 8/1979 | Randell |
| 4,298,489 | A | | 11/1981 | Ohba |
| 4,566,994 | A | | 1/1986 | Hasegawa |
| 4,645,615 | A | | 2/1987 | Drake |
| 4,783,274 | A | | 11/1988 | Jokinen |
| 4,800,030 | A | | 1/1989 | Kaneko |
| 5,094,763 | A | | 3/1992 | Tochigi |
| 5,236,610 | A | | 8/1993 | Perez |
| 5,298,177 | A | | 3/1994 | Stoffa |
| 5,372,736 | A | | 12/1994 | Trivett |
| 5,399,275 | A | | 3/1995 | Lange |
| 6,156,228 | A | * | 12/2000 | Holgado et al. ..... 252/78.2 |

FOREIGN PATENT DOCUMENTS

| | | | |
|---|---|---|---|
| GB | 524937 | A | 8/1940 |
| SU | 654671 | | 3/1979 |
| WO | WO88/05808 | A | 8/1988 |
| WO | WO93/03123 | A | 2/1993 |
| WO | WO93/09209 | A | 5/1993 |

OTHER PUBLICATIONS

Rosauro V. Holgado et al, "Trialkoxyalkylphosphate Based Fire Resistant Fluid Containing Triglyceride", U.S. patent application Ser. No. 08/340,247, filed Nov. 16, 1994.

V. Cheng et al, "Biodegradable and Nontoxic Hydraulic Oils", SAE Technical Paper Series, Apr. 9–10, 1991, No. 910964, 42$^{nd}$ Earthmoving Industry Conference, Peoria, Illinois.

H. Eichenberger, "Biodegradable Hydraulic Lubricant an Overview of Current Developments in Central Europe", SAE Technical Paper Series, Apr. 9–10, 1991, No. 910962, 42$^{nd}$ Earthmoving Industry Conference, Peoria, Illinois.

* cited by examiner

*Primary Examiner*—Yogendra N. Gupta
*Assistant Examiner*—D Hamlin
(74) *Attorney, Agent, or Firm*—Howson and Howson

(57) ABSTRACT

The present invention relates to fire-resistant hydraulic fluids. More particularly, the invention relates to fire-resistant hydraulic fluid compositions comprising the combination of a trialkoxyalkyl-phosphate, a diluent selected from the group consisting of a natural triglyceride, a synthetic ester, and a polypropylene glycol, and a high molecular weight polymer.

26 Claims, No Drawings

FIRE-RESISTANT HYDRAULIC FLUID COMPOSITIONS

This is a divisional of U.S. patent application Ser. No. 08/340,247, filed Nov. 16, 1994, now U.S. Pat. No. 6,156,228, issued Dec. 5, 2000.

FIELD OF THE INVENTION

The present invention relates generally to hydraulic fluids, and more particularly, to hydraulic fluids that have fire resistant properties.

BACKGROUND OF THE INVENTION

Hydraulic fluids are fluids which are used to offer resistance in hydraulically operated mechanisms. The main classes of hydraulic fluids commonly used are petroleum-based [See U.S. Pat. Nos. 4,566,994 and 4,800,030] (composed of chemically saturated or unsaturated, straight-chained, branched or ring-type hydrocarbons [See U.S. Pat. No. 5,236,610]), water/glycol solutions, and water-in-oil emulsions [See U.S. Pat. No. 3,236,778].

There are several notable disadvantages to these conventional types of hydraulic fluids. The petroleum-based hydraulic fluids pose certain environmental and health risks. In addition, petroleum oils may be the least fire-resistant and attempts to improve fire-resistance by the addition of fire-resistant compounds tends to reduce lubricity. Petroleum is a non-renewable and limited natural resource. Moreover, petroleum oil allowed to escape into the ground causes soil and groundwater contamination which can pose additional health and environmental problems.

Water-based hydraulic fluids have disadvantages as well. Hydraulic fluids of this type often lack sufficient mechanical stability and lubricity to operate at high temperatures and pressures.

There is a need for hydraulic fluids which are based on renewable natural resources and which simultaneously have the characteristics of desirable viscosity, lubricity, stability, and volatility while reducing potential harm to the environment.

SUMMARY OF THE INVENTION

In one aspect, the present invention provides a hydraulic fluid composition comprised of a mixture of about 20% to about 90% by weight of a trialkoxyalkyl-phosphate, about 10% to about 80% by weight of a natural triglyceride diluent, and about 0.1% to about 2% by weight of a high molecular weight polymer. In a preferred embodiment, the trialkoxyalkyl-phosphate is tributoxyethyl-phosphate and the natural triglyceride diluent is canola oil.

In another aspect, the present invention provides a hydraulic fluid composition comprised of a mixture of about 20% to about 90% by weight of a trialkoxyalkyl-phosphate, about 10% to about 80% by weight of a synthetic ester diluent, and about 0.1% to about 2% by weight of a high molecular weight polymer. In a preferred embodiment, the trialkoxyalkyl-phosphate is tributoxyethyl-phosphate and the synthetic ester diluent is selected from the group consisting of polyol esters of $C_6$–$C_{18}$ acids and dibasic acid esters of monohydric alcohols.

In a further aspect, the present invention provides a hydraulic fluid composition comprised of a mixture of about 20% to about 90% by weight of a trialkoxyalkyl-phosphate, about 10% to about 80% by weight of a polypropylene glycol diluent, and about 0.1% to about 2% by weight of a high molecular weight polymer. In a preferred embodiment, the trialkoxyalkyl-phosphate is tributoxyethyl-phosphate and the polypropylene glycol diluent is selected from the group consisting of polypropylene glycols of the general formula:

$$R_1O—[CH_2—CH(CH_3)—O]_n—R_2$$

where $R_1$ and $R_2$ are independently selected from the group consisting of H, an alkyl, alkenyl, and alkadienyl chains of from 1 to 18 carbons and n=3–40.

In yet another aspect, the invention provides for the optional addition to any of the above-described hydraulic fluids of at least one compound selected from the following groups: about 0.5% to about 5% by weight antioxidant, about 0.1% to about 2% by weight corrosion inhibitor, about 0% to about 2% by weight antiwear agent, and about 0% to about 10% by weight viscosity modifier.

Further objects, features, and advantages of the present invention will become apparent from the detailed description of the invention and the preferred embodiments that follows.

DETAILED DESCRIPTION OF THE INVENTION

The present invention provides novel fire-resistant hydraulic fluid compositions. One such fluid contains a mixture of a trialkoxyalkyl-phosphate and a natural triglyceride diluent. Another hydraulic fluid of the invention contains a mixture of a trialkoxyalkyl-phosphate and a synthetic ester diluent. Still other fluids of the invention contain a trialkoxyalkyl-phosphate and mixtures of both a natural triglyceride and a synthetic ester. Still another hydraulic fluid of the invention contains a mixture of a trialkoxyalkyl-phosphate and a polypropylene glycol diluent. Yet another hydraulic fluid of the invention contains a trialkoxyalkyl-phosphate and a mixture of a synthetic ester and a polypropylene glycol diluent. Another hydraulic fluid of the invention contains a trialkoxyalkyl-phosphate and a mixture of a natural triglyceride and a polypropylene glycol diluent. In still another hydraulic fluid of the invention, a trialkoxyalkyl-phosphate is mixed with a diluent comprised of a mixture of a natural triglyceride, a synthetic ester, and a polypropylene glycol. Desirably, these compositions also contain a high molecular weight polymer, as defined herein.

The inventors have found that the use of the hydraulic fluid compositions of the present invention improves fire resistance. As used herein, "fire resistance" refers to the ability of a fluid to pass the flame propagation and hot surface ignition tests described below in Example 7. The hydraulic fluid compositions also have a lower heat of combustion compared to hydraulic fluids lacking phosphate esters. See, e.g., Table II of Example 1.

Hydraulic fluids of the present invention contain between about 20% to about 90% by weight of a trialkoxyalkyl-phosphate. Trialkoxyalkyl-phosphates may be represented by the general formula: $(R_3—O)_3P=O$ where $R_3$ is $(C_nH_{2n+1}—O—C_mH_{2m+1})$ where n is between 1 and 18 and m is between 2 and 6. These trialkoxyalkyl-phosphates are further characterized as having a high flash point and a low heat of combustion, and as being nontoxic and environmentally acceptable. In a preferred embodiment, the trialkoxyalkyl-phosphate is tributoxyethyl-phosphate. However, any trialkoxyalkyl-phosphate of the above formula may readily be incorporated in the compositions of the present invention.

The preferred hydraulic fluids of the invention also may contain between about 10% to about 80% of a natural triglyceride as a diluent. The natural triglycerides used in the hydraulic fluid compositions of the present invention are glycerol esters of fatty acids, and the chemical structure of these esters can be defined by the following formula:

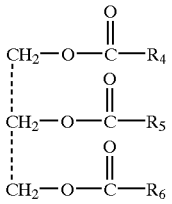

wherein $R_4$, $R_5$, and $R_6$ can be the same or different and are selected from the group consisting of saturated and unsaturated straight-chained alkyl, alkenyl, and alkadienyl chains of 9 to 22 carbon atoms. These triglycerides are further characterized by having a high flash point (over 500° F. C.O.C.). As defined herein "C.O.C." refers to the Cleveland Open Cup test, a standard measurement of flash point.

Several modified versions of these natural triglycerides may be included in the hydraulic fluids of the present invention. Such modifications may be made in the natural triglycerides by oxidation, polymerization, hydrogenation, and transesterification thereof.

Conventional animal fats and vegetable oils provide a convenient source for the natural triglyceride diluents useful in the invention. In a preferred embodiment, the vegetable oil is canola oil. Other suitable vegetable oils include corn oil, cottonseed oil, sunflower oil, peanut oil, soybean oil, coconut oil, Jojoba oil, castor oil, palm oil, and palm kernel oil. These natural triglycerides are readily available from commercial sources, including, for example, Calgene, Inc., Pfau, Inc., Acme Hardestry, Inc., and Resource Material Corp.

These natural triglycerides have numerous properties which are advantageous in hydraulic fluids. The use of natural triglycerides as diluents in hydraulic fluids confers the benefit of a low cost, renewable, natural resource which is environmentally acceptable in contrast to conventional petroleum-based hydraulic fluids. Natural triglycerides possess a greater viscosity stability at varying temperatures compared to mineral oil (petroleum-based) products. The structure of triglycerides is apparently equally stable against mechanical stresses in hydraulic pumps than mineral oil-based fluids when compounded properly. In addition, due to the polarity of triglycerides, it is expected that their ability to adhere to metal surfaces provides superior lubricity. Triglyceride-based hydraulic fluids also have a lower heat of combustion than conventional petroleum-based hydraulic fluids. The fire and flash points of triglycerides are clearly higher than that of hydrocarbon basic oils.

Given these guidelines, one of skill in the art could readily select other natural triglycerides to be included in the hydraulic fluid compositions of the present invention.

Another embodiment of the hydraulic fluid compositions of the present invention contains a synthetic ester as the diluent component. The synthetic ester diluent is selected from the group consisting of polyol esters of $C_6$–$C_{18}$ acids and dibasic acid esters of monohydric alcohols. These synthetic esters may be derived from polyhydric alcohols reacted with monobasic acids or polybasic acids reacted with monohydric alcohols. In a preferred embodiment, the synthetic ester may be diisononyl phthalate. In another preferred embodiment, the synthetic ester may be a pentaerythritol ester mixture of capric and caprylic acids. One suitable commercially available pentaerythritol ester is available from the Stepan Chemical Corporation under the trademark Kesco 874™. Other synthetic esters may also be commercially obtained.

The synthetic ester may be used in place of, or as a supplement to, the natural triglycerides. When used as the sole diluent, the synthetic ester is present in amounts of about 10% to about 80% by weight. When used to supplement the natural triglycerides, the synthetic ester may be present in amounts of about 15% to about 30% by weight and the triglyceride in amounts of 40% to about 60% by weight.

Another embodiment of the hydraulic fluid compositions of the present invention contains polypropylene glycol as the diluent component. In a preferred embodiment, the polypropylene glycol diluent is selected from the group consisting of polypropylene glycols of the general formula:

$$R_1O—[CH_2—CH(CH_3)—O]_n—R_2$$

where $R_1$ and $R_2$ are independently selected from the group consisting of H, an alkyl, alkenyl, and alkadienyl chains of from 1 to 18 carbons in length and n=3–40. One such commercially available polypropylene glycol is manufactured by the Union Carbide Corporation under the trademark UCON LB-625™. The polypropylene glycol constituent provides the present hydraulic fluid compositions with a low heat of combustion, high lubricity, and high hydrolytic and thermal stability.

The polypropylene glycol may be used in place of, or as a supplement to, the natural triglycerides. In addition, the polypropylene glycol may be used either alone or in combination with the synthetic esters described above. Another embodiment of the hydraulic fluid compositions contains as the diluent a mixture of a natural triglyceride as described above, a synthetic ester, and a polypropylene glycol. When used as the sole diluent, the polypropylene glycol is present in amounts of about 10% to about 80% by weight. When used to supplement the natural triglycerides, the polypropylene glycol may be present in amounts of about 15% to about 30% by weight and the triglyceride in amounts of 40% to about 60% by weight.

The hydraulic fluids of this invention also contain between about 0.1% to about 2% by weight of a high molecular weight polymer soluble in the selected diluent. As used herein, "high molecular weight" refers to polymers having a molecular weight of at least 50,000. The incorporation of high molecular weight polymers improves fire resistance of the hydraulic fluid compositions of the present invention. Particularly desirable are polymers selected from the group consisting of polystyrene, styrene-butadiene copolymers, polyesters, polymethacrylates, polyvinyl acetate, and vinyl chloride acetate copolymers. These polymers are commercially available, such as the styrene butadiene copolymer manufactured by the Lubrizol Corporation under the trademark Lubrizol 5994™. In a preferred embodiment, the high molecular weight polymer is selected from the group consisting of a mixture of methyl methacrylate and n-butyl methacrylate resin, a mixture of vinyl chloride, vinyl acetate, and vinyl alcohol terpolymer, and a copolymer of styrene and maleic anhydride. These polymers are also commercially available, e.g., a methyl methacrylate and n-butyl methacrylate resin mixture manufactured by the Degussa Corporation under the trademark Degalan LP-62/05™, and a copolymer of styrene and maleic anhydride manufactured by the Monsanto Corporation under the trademark Scripset 520™ resin. Other polymers soluble in the diluent constituent may readily be included by one of skill in the art.

Optionally, other conventional hydraulic fluid components may be added to the hydraulic fluid compositions of the present invention. Such optional components include, for example, antioxidants, corrosion inhibitors, antiwear agents, and viscosity modifiers.

Antioxidants are useful additives for preventing the degradation of the hydraulic fluid through oxidation. Antioxidants are desirably present in the hydraulic fluids in the amount of about 0.5% to about 5% by weight. Such antioxidants may be selected from the group consisting of aromatic amine, quinoline, and phenolic compounds. One such antioxidant which is commercially available is an alkylated diphenyl amine produced by the Vanderbilt Corporation under the trademark Vanlube NA™. Although polymerized trimethyl-dihydro-quinoline (commercially available from the Vanderbilt Corporation under the trademark Vanlube RD™) and 4,4'-methylene bis(2,6-di-tert-butylphenol) are preferred, other antioxidants may be readily selected by one of skill in the art.

Suitable corrosion inhibitors for both ferrous and non-ferrous metals may be selected from the battery of conventional corrosion inhibitors used in the industry. Corrosion inhibitors are desirably present in the hydraulic fluid compositions of the present invention in the amount of about 0.1% to about 2% by weight. A preferred corrosion inhibitor is tolyltriazole, however, other known and commercially available corrosion inhibitors could readily be used by one of skill in the art.

Similarly, numerous antiwear agents or lubricants are known in industry. Antiwear agents are optionally present in the hydraulic fluids of the present invention in the amount of about 0% to about 2% by weight. Preferred antiwear agents used in the hydraulic fluid compositions are selected from the group consisting of an amine phosphate which results from the reaction of mono and di-hexyl phosphate with $C_{11}$–$C_{14}$ branched alkyl amines. One such commercially available antiwear agent is produced by the Ciba-Geigy Corporation under the trademark Irgalube 349™. One of skill in the art could readily include other suitable phosphorous and sulfur based antiwear agents.

Conventional viscosity modifiers may optionally be included in the hydraulic fluid compositions of the present invention. Viscosity modifiers are optionally present in the hydraulic fluid compositions in the amount to about 0% to about 10% by weight. A viscosity modifier selected from the group consisting of a dimer acid ester and polymerized vegetable oil is preferred. One suitable commercially available viscosity modifier is a dimer acid ester available from Unichema International, Inc. under the trademark Priolube 3986™. Other such modifiers may be selected by one of skill in the art.

The following Examples of the invention illustrate selected embodiments of the hydraulic fluid compositions only and are not intended to limit the invention.

EXAMPLE 1

The following hydraulic fluid composition of the invention is prepared according to the protocol described below using the following components:

| Component | Amount by Weight |
|---|---|
| tributoxyethyl-phosphate | about 20% |
| canola oil | about 75.4% |

-continued

| Component | Amount by Weight |
|---|---|
| tolyltriazole | about 0.1% |
| amine phosphate resulting from the reaction of mono and di-hexyl phosphate with $C_{11}$—$C_{14}$ branched alkyl amines (Irgalube 349 ™) | about 1% |
| polymerized trimethyl-dihydro-quinoline (Vanlube RD ™) | about 1.5% |
| 4,4'-methylene bis(2,6-di-tert-butylphenol) | about 1% |
| styrene butadiene copolymer (Lubrizol 5994 ™) | about 1% |

A portion of canola oil (approximately 16% of the total canola oil by weight) is heated to 170° C. and styrene-butadiene copolymer is dissolved in it (1–2 hours). This solution is set aside. All of the other ingredients are admixed and heated to 60° C. until all of the solids dissolve (1 hour). Then, the styrene-butadiene copolymer/canola oil solution is blended in until the resulting solution is homogeneous (1 hour).

EXAMPLE 2

The following hydraulic fluid composition of the invention is prepared according to the protocol described below using the following components:

| Component | Amount by Weight |
|---|---|
| tributoxyethyl-phosphate | about 40% |
| canola oil | about 51.4% |
| tolyltriazole | about 0.1% |
| amine phosphate resulting from the the reaction of mono and di-hexyl phosphate with $C_{11}$—$C_{14}$ branched alkyl amines (Irgalube 349 ™) | about 1% |
| polymerized trimethyl-dihydro-quinoline (Vanlube RD ™) | about 1.5% |
| 4,4'-methylene bis(2,6-di-tert-butylphenol) | about 1% |
| styrene butadiene copolymer (Lubrizol 5994 ™) | about 1.0% |
| dimer acid ester (Priolube 3986 ™) | about 4% |

A portion of canola oil (approximately 16% of the total canola oil by weight) is heated to 170° C. and the styrene-butadiene copolymer is dissolved in it (1–2 hours). This solution is set aside. All of the other ingredients are admixed and heated to 60° C. until all of the solids dissolve (1 hour). Then, the styrene-butadiene copolymer/canola oil solution is blended in until the resulting solution is homogeneous (1 hour).

EXAMPLE 3

The following hydraulic fluid composition of the invention is prepared according to the protocol described below using the following components:

| Component | Amount by Weight |
|---|---|
| tributoxyethyl-phosphate | about 20% |
| pentaerythritol esters of mixed capric and caprylic acids (Kesco 874 ™) | about 75.4% |

-continued

| Component | Amount by Weight |
|---|---|
| tolyltriazole | about 0.1% |
| amine phosphate resulting from the reaction of mono and di-hexyl phosphate with $C_{11}$—$C_{14}$ branched alkyl amines (Irgalube 349 ™) | about 1% |
| polymerized trimethyl-dihydro-quinoline (Vanlube RD ™) | about 1.5% |
| 4,4'-methylene bis(2,6-di-tert-butylphenol) | about 1% |
| solution of styrene-butadiene copolymer (Lubrizol 5994 ™) | about 1% |

A portion of pentaerythritol esters of capric and caprylic acids (approximately 16% of the total pentaerythritol esters by weight) is heated to 170° C. and the styrene-butadiene copolymer is dissolved in it (2 hours). This solution is set aside. All of the other ingredients are heated to 60° C. until all solids dissolve. Then, the styrene-butadiene copolymer/pentaerythritol solution is blended in until the resulting solution is homogeneous (1 hour).

EXAMPLE 4

The following hydraulic fluid composition of the invention is prepared according to the protocol described below using the following components:

| Component | Amount by Weight |
|---|---|
| tributoxyethyl-phosphate | about 48.9% |
| polypropylene glycol capped on one end with a butyl group (UCON LB-625 ™) | about 48.9% |
| tolyltriazole | about 0.1% |
| amine phosphate resulting from the reaction of mono- and di-hexyl phosphate with $C_{11}$—$C_{14}$ branched alkyl-amines (Irgalube 349 ™) | about 1% |
| copolymer of styrene and maleic anhydride (Scripset 520 ™ resin) | about 1% |

All of the above ingredients except the copolymer of styrene and maleic anhydride are admixed and heated to 60° C. until all solids dissolve (1 hour). The copolymer of styrene and maleic-anhydride is gradually mixed in over a period of about 20 minutes and blended until a solution is obtained (2 hours).

EXAMPLE 5

The following hydraulic fluid composition of the invention is prepared according to the protocol described below using the following components:

| Component | Amount by Weight |
|---|---|
| tributoxyethyl-phosphate | about 20% |
| dibasic acid esters of monohydric alcohols (diisononyl phthalate) | about 75.4% |
| tolyltriazole | about 0.1% |
| amine phosphate resulting from the reaction of mono and di-hexyl phosphate with $C_{11}$—$C_{14}$ branched alkyl amines (Irgalube 349 ™) | about 1% |

-continued

| Component | Amount by Weight |
|---|---|
| polymerized trimethyl-dihydro-quinoline (Vanlube RD ™) | about 1.5% |
| 4,4'-methylene bis(2,6-di-tert-butylphenol) | about 1% |
| 20% solution of styrene-butadiene copolymer (Lubrizol 5994 ™) in diisononyl phthalate | about 1% |

A portion of dibasic acid esters of monohydric alcohols (16% of the total diisononyl phthalate by weight) is heated to 170° C. and the styrene-butadiene copolymer is dissolved in it (1–2 hours). This solution is set aside. All of the other ingredients are admixed and heated to 60° C. until all of the solids dissolve (1 hour). Then, the styrene-butadiene copolymer/dibasic acid ester solution is blended in until the resulting solution is homogeneous (1 hour).

EXAMPLE 6

The following hydraulic fluid composition of the invention is prepared according to the protocol described below using the following components:

| Component | Amount by Weight |
|---|---|
| tributoxyethyl-phosphate | about 47.9% |
| polypropylene glycol capped on one end with a butyl group (UCON LB-625 ™) | about 47.9% |
| tolyltriazole | about 0.1% |
| amine phosphate resulting from the reaction of mono and di-hexyl phosphate with $C_{11}$—$C_{14}$ branched alkyl amines (Irgalube 349 ™) | about 1% |
| alkylated diphenyl amine (Vanlube NA ™) | about 1% |
| 4,4'-methylene bis(2,6-di-tert-butylphenol) | about 1% |
| methyl methacrylate and n-butyl methacrylate resin mixture (Degalan LP-62/05 ™) | about 1.1% |

All of the above ingredients except the resin mixture are admixed and heated to 60° C. until all solids dissolve (1 hour). The methyl methacrylate and n-butyl methacrylate resin mixture is gradually mixed in over a period of about 20 minutes and blended until a solution is obtained (2 hours).

EXAMPLE 7

Two fire resistance tests were conducted for each of the compounds described in the above Examples. Each sample tested performed satisfactorily in both tests.

A. Flame Propagation Test

In the flame propagation test, a sample of each fluid is heated to 140° F. in separate steel containers, then pressurized with nitrogen to 1000 psi (6.9 MPa). The samples were discharged into an open space from an 80 degree hollow cone HAGO oil burner nozzle rated for 1.5 gal/hr (5.7 L) at 100 psi (0.69 MPa). A propane-air torch flame is then passed through the atomized spray at distances of 6 and 18 inches (152 and 457 mm) from the nozzle tip. Ten attempts at ignition were made at each distance and the resulting ignition durations were timed. Each fluid passes this test if the spray flame self-extinguishes within five seconds after removal of the propane flame.

In each of the samples tested (Examples 1–6 above), the fluid spray flames self-extinguished in less than five seconds after removal of the propane flame. Table I below provides flame propagation test data for the hydraulic fluid compositions described in Examples 2 and 6.

TABLE I

| Flame Propagation Tests | | | | | | | | | | |
|---|---|---|---|---|---|---|---|---|---|---|
| Attempt No. | 1 | 2 | 3 | 4 | 5 | 6 | 7 | 8 | 9 | 10 |
| Fluid of Example 2: torch flame 6" from nozzle ignition | | | | | | | | | | |
| Burning Time in seconds | 3 | 4 | 4 | 2 | 1 | 3 | 2 | 1 | 2 | 3 |
| Fluid of Example 2: torch flame 18" from nozzle ignition | | | | | | | | | | |
| Burning Time in seconds | 1 | 1 | 1 | 1 | 1 | 1 | 1 | 1 | 1 | 1 |
| Fluid of Example 6: torch flame 6" from nozzle ignition | | | | | | | | | | |
| Burning Time in seconds | 3 | 2 | 4 | 2 | 2 | 3 | 2 | 2 | 2 | 2 |
| Fluid of Example 6: torch flame 18" from nozzle ignition | | | | | | | | | | |
| Burning Time in seconds | 1 | 1 | 1 | 1 | 1 | 1 | 1 | 1 | 1 | 1 |

B. Heat of Combustion

The heats of combustion of several hydraulic fluids lacking phosphate esters were compared with the hydraulic fluids of this invention. Each of the products listed in Table II are produced by Houghton International, Inc. and are commercially available. As revealed in Table II below, the products of this invention have lower heats of combustion.

TABLE II

| Product | Gross Heat of Combustion BTU/LB | Flash Point C.O.C. ° F. |
|---|---|---|
| Non-Phosphate Esters | | |
| Hydro-Drive HP-200 (Mineral Oil with additives) | 19752 | 430 |
| Cosmolubric HF-130 (Trimethylol propane trioleate with additives) | 17119 | 530 |
| Cosmolubric HF-122 (Neopentylglycol dioleate with additives) | 17249 | 520 |
| Cosmolubric HF-144 (Pentaerythritol tetraoleate with additives) | 17057 | 535 |
| Cosmolubric B-230 (Canola Oil with additives) | 17061 | 590 |
| Phosphate Esters | | |
| Houghto-safe 1120 (triaryl phosphate with additives) | 13963 | 485 |
| Formula of Example 2 above | 15295 | 470 |
| Formula of Example 6 above | 13148 | 480 |

Numerous modifications and variations of the present invention are included in the above-identified specification and are expected to be obvious to one of skill in the art. In addition, modifications and alterations to the compositions of the invention in the form of additional conventional components may be selected by one of skill in the art and are believed to be encompassed in the scope of the claims appended hereto.

What is claimed is:

1. A fire-resistant hydraulic fluid comprising a mixture of about 20 to 90% by weight of a trialkoxyalkyl-phosphate, about 10 to 80% by weight of a diluent consisting essentially of a synthetic ester which is selected from the group consisting of polyol esters of $C_6$ to $C_{18}$ acids, polybasic acid esters of monohydric alcohols, and monobasic acid esters of polyhydric alcohols, and about 0.1 to 2% by weight high molecular weight polymer.

2. The hydraulic fluid according to claim 1, wherein said synthetic ester is a pentaerythritol ester mixture of capric and caprylic acids.

3. A fire resistant hydraulic fluid comprising a mixture of about 20 to 90% by weight of a trialkoxyalkyl-phosphate, about 10 to 80% by weight of a diluent consisting essentially of a polypropylene glycol, and about 0.1 to 2% by weight high molecular weight polymer.

4. The hydraulic fluid according to claim 3, wherein said polypropylene glycol is selected from the group consisting of polypropylene glycols of the general formula:

$$R_1O—[CH_2—CH(CH_3)—O]_n—R_2$$

wherein $R_1$ and $R_2$ are independently selected from the group consisting of H, an alkyl, alkenyl, and alkadienyl chain of 1 to 18 carbons in length, and n=3 to 40.

5. The hydraulic fluid according to claim 3, wherein the trialkoxyalkyl-phosphate is tributoxyethyl-phosphate.

6. The hydraulic fluid according to claim 3, wherein said high molecular weight polymer is selected from the group consisting of polystyrene, styrene-butadiene copolymers, polyesters, polymethacrylates, polyvinyl acetate, and vinyl chloride-vinyl acetate copolymers.

7. The hydraulic fluid according to claim 6, wherein said high molecular weight polymer is selected from the group consisting of a mixture of methyl methacrylate and n-butyl methacrylate resin, a mixture of vinyl chloride, vinyl acetate, and vinyl alcohol terpolymer, and a copolymer of styrene and maleic anhydride.

8. The hydraulic fluid according to claim 3, further comprising at least one compound selected from the group consisting of an antioxidant, a corrosion inhibitor, an antiwear agent, and a viscosity modifier.

9. The hydraulic fluid according to claim 8, wherein the antioxidant is selected from the group consisting of polymerized trimethyl dihydro quinoline, and 4,4'-methylene bis(2,6-di-tert-butylphenol);

the corrosion inhibitor is tolyltriazole;

the antiwear agent is an amine phosphate resulting from the reaction of a mono and di-hexyl phosphate with $C_{11}$ to $C_{14}$ branched alkyl amines; and the viscosity modifier is selected from the group consisting of a dimer acid ester and polymerized vegetable oil.

10. The hydraulic fluid according to claim 8 comprising:

about 20 to 90% by weight tributoxyethyl-phosphate;

about 10 to 80% by weight polypropylene glycol of the formula:

$$R_1O—[CH_2—CH(CH_3)—O]_n—R_2$$

wherein $R_1$ and $R_2$ are independently selected from the group consisting of H, an alkyl, alkenyl, and alkadienyl chain of 1 to 18 carbons in length, and n=3 to 40;

about 0.1% by weight corrosion inhibitor;

about 1% by weight antiwear agent;

about 1% by weight high molecular weight copolymer;

about 2.5% by weight antioxidant; and about 0 to 10% by weight viscosity modifier.

11. The hydraulic fluid according to claim 10 wherein the antiwear agent is an amine phosphate resulting from the reaction of mono and di-hexyl phosphate with $C_{11}$ to $C_{14}$ branched alkyl amines.

12. The hydraulic fluid according to claim 10 wherein the antioxidant is a mixture of polymerized trimethyl-dihydroquinoline and 4,4'-methylene bis(2,6-di-tert-butylphenol).

13. The hydraulic fluid according to claim 10 wherein the high molecular weight copolymer is selected from the group consisting of a mixture of methyl methacrylate and n-butyl methacrylate resin, a mixture of vinyl chloride, vinyl acetate, and vinyl alcohol terpolymer, and a copolymer of styrene and maleic anhydride.

14. The hydraulic fluid according to claim 10 wherein the corrosion inhibitor is tolyltriazole.

15. The hydraulic fluid according to claim 10 wherein the viscosity modifier is selected from the group consisting of a dimer acid ester and polymerized vegetable oil.

16. The hydraulic fluid according to claim 10 comprising about 48.9% by weight tributoxyethyl-phosphate, about 48.9% by weight polypropylene glycol capped on one end with a butyl group, about 0.1% by weight tolyltriazole, about 1% by weight amine phosphate resulting from the reaction of mono- and di-hexyl phosphate with $C_{11}$ to $C_{14}$ branched alkyl-amines, and about 1% by weight copolymer of styrene and maleic anhydride.

17. The hydraulic fluid according to claim 10 comprising about 47.9% by weight tributoxyethyl-phosphate, about 47.9% by weight polypropylene glycol capped on one end with a butyl group, about 0.1% by weight tolyltriazole, about 1% by weight amine phosphate resulting from the reaction of mono and di-hexyl phosphate with $C_{11}$ to $C_{14}$ branched alkyl amines, about 1% by weight alkylated diphenyl amine, about 1% by weight 4,4'-methylene bis(2,6-di-tert-butylphenol), and about 1.1% by weight methyl methacrylate and n-butyl methacrylate resin mixture.

18. A fire-resistant hydraulic fluid comprising:

about 20 to 90% by weight tributoxyethyl-phosphate;

about 10 to 80% by weight synthetic ester selected from the group consisting of a polyol ester of $C_6$ to $C_{18}$ acids and polybasic acid esters of monohydric alcohols and monobasic acid esters of polyhydric alcohols; and about 1% by weight high molecular weight copolymer.

19. The hydraulic fluid according to claim 18 further comprising:

about 0.1% by weight corrosion inhibitor;

about 1% by weight antiwear agent;

about 2.5% by weight antioxidant; and about 0 to 10% by weight viscosity modifier.

20. The fluid according to claim 19 wherein the antiwear agent is an amine phosphate resulting from the reaction of mono and di-hexyl phosphate with $C_{11}$ to $C_{14}$ branched alkyl amines.

21. The hydraulic fluid according to claim 19 wherein the antioxidant is a mixture of polymerized trimethyl-dihydro-quinoline and 4,4'-methylene bis(2,6-di-tert-butylphenol).

22. The hydraulic fluid according to claim 19 wherein the high molecular weight copolymer is selected from the group consisting of a mixture of methyl methacrylate and n-butyl methacrylate resin, a mixture of vinyl chloride, vinyl acetate, and vinyl alcohol terpolymer, and a copolymer of styrene and maleic anhydride.

23. The hydraulic fluid according to claim 19 wherein the viscosity modifier is selected from the group consisting of a dimer acid ester and polymerized vegetable oil.

24. The hydraulic fluid according to claim 19 wherein the corrosion inhibitor is tolyltriazole.

25. The hydraulic fluid according to claim 19 comprising about 20% by weight tributoxyethyl-phosphate, about 75.4% by weight pentaerythritol esters of mixed capric and caprylic acids, about 0.1% by weight tolyltriazole, about 1% by weight amine phosphate resulting from the reaction of a mono and di-hexyl phosphate with $C_{11}$ to $C_{14}$ branched alkyl amines, about 1.5% by weight polymerized trimethyl-dihydro-quinoline, about 1% by weight 4,4'-methylene bis (2,6-di-tert-butylphenol), and about 1% by weight solution of styrene-butadiene copolymer.

26. The hydraulic fluid according to claim 19 comprising about 20% by weight tributoxyethyl-phosphate, about 75.4% by weight dibasic acid esters of monohydric alcohols, about 0.1% by weight tolyltriazole, about 1% by weight amine phosphate resulting from the reaction of mono and di-hexyl phosphate with $C_{11}$ to $C_{14}$ branched alkyl amines, about 1.5% by weight polymerized triethyl-dihydro-quinoline, about 1% by weight 4,4'-methylene bis(2,6-di-tert-butylphenol), and about 1% by weight solution of styrene-butadiene copolymer in $C_8$ to $C_{10}$ pentaerythritol ester.

* * * * *